United States Patent [19]

Moriya

[11] 4,157,891

[45] Jun. 12, 1979

[54] FUEL FLOW ADJUSTING DEVICE FOR USE IN GAS-FUELED LIGHTERS

[75] Inventor: Nobuyoshi Moriya, Omiya, Japan

[73] Assignee: Mansei Kogyo Kabushiki Kaisha, Saitama, Japan

[21] Appl. No.: 759,641

[22] Filed: Jan. 17, 1977

Related U.S. Application Data

[62] Division of Ser. No. 610,081, Sep. 3, 1975, Pat. No. 4,080,156.

[30] Foreign Application Priority Data

Sep. 4, 1974 [JP] Japan ..... 49/106178[U]

[51] Int. Cl.[2] ..... F23Q 2/42

[52] U.S. Cl. ..... 431/344; 251/65

[58] Field of Search ..... 431/344; 251/65

[56] References Cited

U.S. PATENT DOCUMENTS

| | | | |
|---|---|---|---|
| 3,114,249 | 12/1963 | Lowenthal | 431/344 |
| 3,254,511 | 6/1966 | Burchett et al. | 431/150 |
| 3,320,775 | 5/1967 | Wright | 431/344 |
| 3,533,720 | 10/1970 | Quercia | 431/277 |
| 3,705,785 | 12/1972 | Goto | 431/344 |
| 3,770,367 | 11/1973 | Court | 431/277 |

FOREIGN PATENT DOCUMENTS

| | | | |
|---|---|---|---|
| 1134397 | 11/1968 | United Kingdom | 431/344 |

*Primary Examiner*—Henry C. Yuen
*Attorney, Agent, or Firm*—Armstrong, Nikaido, Marmelstein & Kubovcik

[57] ABSTRACT

A fuel flow adjusting device for use in gas-fueled lighters includes a coarse fuel flow adjuster arranged rotatably within an outer cylindrical body in threaded engagement therewith, and a fine fuel flow adjuster arranged rotatably within said coarse fuel flow adjuster in threaded engagement therewith, wherein a fuel flow adjustment is carried out by said coarse fuel flow adjuster and said fine fuel flow adjuster in combination.

17 Claims, 7 Drawing Figures

FUEL FLOW ADJUSTING DEVICE FOR USE IN GAS-FUELED LIGHTERS

This is a division of application Ser. No. 610,081, filed Sept. 3, 1975, now U.S. Pat. No. 4,080,156.

BACKGROUND OF THE INVENTION

The present invention relates to an improved fuel flow adjusting device for use in gas-fueled lighters and more paticularly to a fuel flow adjusting device in which a coarse fuel flow adjusting means and a fine fuel flow adjusting means are arranged in a body in a lighter valve.

Heretofore, various kinds of fuel flow adjusting devices wherein both a coarse fuel flow adjusting means and a fine fuel flow adjusting means are used to control the flow of fuel gas have been disclosed. However, in these conventional fuel flow adjusting devices, the abovementioned two different means are settled separately in a lighter body. This requires a wide space for fuel flow adjusting devices and causes bulkiness of a lighter. Further in these conventional fuel flow adjusting devices, any mechanism is not provided for preventing said fuel flow adjusting devices from falling off out of a lighter body in the course of careless adjustment of fuel flow.

Therefore, it is an object of the present invention to provide a simple and safe fuel flow adjusting device for use in gas-fueled lighters.

Another object of the present invention is to provide a fuel flow adjusting device in which a course fuel flow adjusting means and a fine fuel flow adjusting means are arranged in a body in a lighter valve.

Still another object of the present invention is to provide a fuel flow adjusting device which is provided with a mechanism adapted to secure safe actuation thereof.

According to the present invention, there is provided a fuel flow adjusting device for use in gas-fueled lighters, comprising an outer cylindrical body fixedly secured to an upper and lower walls of a fuel tank and having an axially-hollow interior, said outer cylindrical body provided with a transverse opening adapted to make a fuel communication between said fuel tank and said axially-hollow interior of said outer cylinderical body, a fuel discharge nozzle mounted on the upper portion of said outer cylinderical body and biased downwards by a spring, a resilient member provided on said fuel discharge nozzle at the lower end to control the fuel discharged from the nozzle, an adjusting wad positioned in said axially-hollow interior of said outer cylinderical body and adapted to change the amount of fuel gas to said discharge nozzle, a coarse fuel flow adusting means arranged within said axially-hollow interior of said outer cylindrical body in rotatably threaded engagement with said outer cylindrical body, a fine fuel flow adjusting means disposed in said coarse fuel flow adjusting means one end of which contacts said adjusting wad, and said fine fuel flow adjusting means rotatably moveable toward and away from said adjusting wad upon threaded engagement with said coarse fuel flow adjusting means.

DETAILED DESCRIPTION OF THE INVENTION

Figure 1:
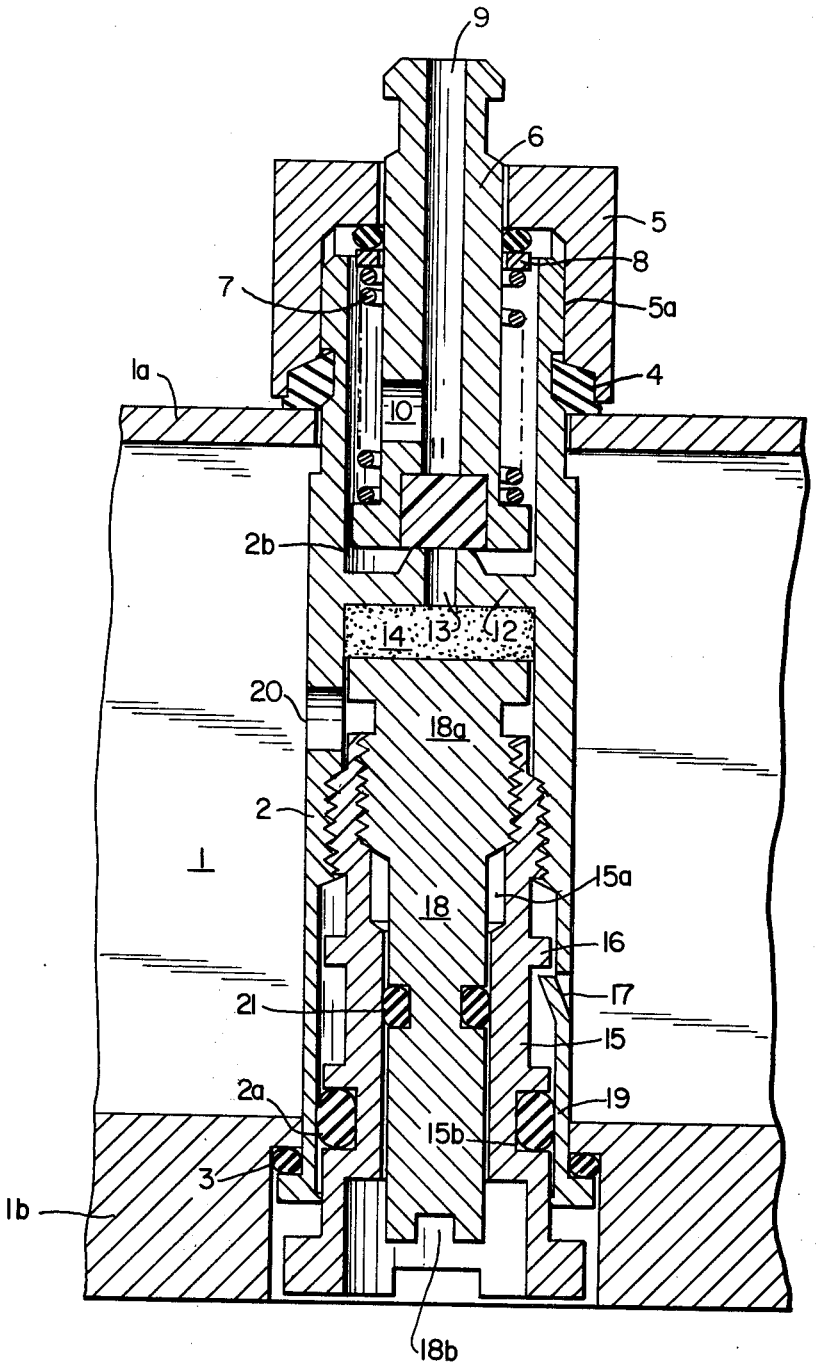
FIG. 1 is a longitudinal sectional view showing one embodiment according to the present invention.

FIG. 1 shows one embodiment of the present invention. Referring now to FIG. 1, a fuel tank designated by numeral 1 is defined by an upper wall 1*a* and a bottom wall 1*b*. Said fuel tank 1 has an outer cylindrical body 2 extending longitudinally from said upper wall 1*a* to said bottom wall 1*b* of said fuel tank 1. Said outer cylindrical body 2 abuts at the lower part 2*a* thereof against said bottom wall 1*b* of said fuel tank 1 through a gasket 3. At the upper part 2*b* thereof, it is in threaded engagement with a burner sleeve 5 and kept in position on the fuel tank 1 through a packing 4. Said burner sleeve 5 functions to tightly fix said outer cylindrical body 2 between said upper wall 1*a* and said bottom wall 1*b* of said fuel tank 1.

Located in the upper section of said outer cylindrical body 2 is a discharge nozzle cylinder 6 which is always biased on the downward direction by a spring 7. This spring 7 has one end mounted on the bottom portion of said discharge nozzle cylinder 6 and the other end on a boss 8 of said discharge nozzle cylinder 6. Said discharge nozzle cylinder 6 terminates beyond said burner sleeve 5. Said discharge nozzle cylinder 6 has a longitudinally axial bore 9 crossing at a right angle a side opening 10 formed on said discharge nozzle cylinder 6 and extends to the downward end which is bordered by a resilient member 11. Said resilient member 11 contacts a top plate 12 prepared on said outer cylindrical body 2 to close a bore 13 which is formed on said top plate 12 and which communicates the interior of said fuel tank 1 with the discharge nozzle cylinder 6. Mounted in abutment on the inner side of said top plate 12 is an adjusting wad of resilient porous material 14. Said porous adjusting wad 14 is adpted to change the supply of fuel gas flow to said fuel discharge nozzle cylinder 6.

Installed in the lower section of said outer cylindrical body 2 is a coarse fuel flow adjuster 15. Said coarse fuel flow adjuster 15 has a threaded portion at the upper part thereof in rotatably threaded engagement with said outer cylindrical body 2. Said coarse fuel flow adjuster 15 is integrally formed with a flange 16 on the outer periphery thereof. A pawl 17 is formed on said outer cylindrical body 2 which is integrally bent inwardly from the side wall of said outer cylindrical body 2. Said pawl 17 serves as a stopper and is adapted to engage said flange 16 of said coarse fuel flow adjuster 15 at a predetermined rotation of said coarse fuel flow adjuster 15 in a counter-clockwise direction. Namely, the turn of said coarse fuel flow adjuster 15 in the counter-clockwise direction is limitted by the engagement between said flange 16 of said coarse fuel flow adjuster 15 and said pawl 17 of said outer cylindrical body 2. Thus, said flange 16 and said pawl 17 constitute a controlling means to limit the downward movement of said coarse fuel flow adjuster 15. As a result of this construction, said coarse fuel flow adjuster 15 is prevented from falling off out of said outer cylindrical body 2 in the course of loosening the pressure on said porous adjusting wad 14.

Said coarse fuel flow adjuster 15 has an axially-hollow interior 15*a* within which a fine fuel flow adjuster 18 is rotatably arranged. Said fine fuel flow adjuster 18 has a pressure head and a central axis. This pressure head has a threaded portion on the outer periphery thereof which is in rotatably threaded engagement with an upper part of said coarse fuel flow adjuster 15. Said pressure head extends upwardly beyond the top end of said coarse fuel flow adjuster 15 and terminates in a relatively larger end 18*a*. On the other hand, Said central axis is formed with a slit 18*b*. Said slit 18*b* facilitates the rotation of said fine fuel flow adjuster 18 by a tool. Said relatively larger end 18*a* of said fine fuel flow adjuster 18 is adapted to move toward and away from said porous adjusting wad 14 in accordance with the rotation of said coarse fuel flow adjuster 15 so as to effect a pressure change on said porous adjusting wad 14. The subsequent and simultaneous change of fuel gas flow is then effected by such a pressure alteration on said adjusting wad 14. If said coarse fuel flow adjuster 15 is turned in clockwise direction, said relatively larger end 18*a* of said fine fuel flow adjuster 18 moves upwards togehter with said coarse fuel flow adjuster 15 toward said porous adjusting wad 14 so as to apply an increased pressure on said porous adjusting wad 14. This operation causes a reduction of fuel gas flow to said fuel discharge nozzle cylinder 6. If said coarse fuel flow adjuster 15 is turned in a counter-clockwise direction, said relatively larger end 18*a* of said fine fuel flow adjuster 18 moves backwards togehter with said coarse fuel flow adjuster 15 away from said porous adjusting wad 14 so as to loosen a pressure on said porous adjusting wad 14. This operation causes an increase of fuel gas flow to said fuel discharge nozzle cylinder 6. Said coarse fuel flow adjuster 15 moves backwards together with said fine fuel flow adjuster 18 until said flange 16 of said coarse fuel flow adjuster 15 abuts against said pawl 17 of said outer cylindrical body 2. As a result of this construction, said increase of fuel gas flow to said fuel discharge nozzle cylinder 6 is limitted to a predetermined extent. Coarse fuel flow adjustment is carried out in such a way as mentioned as above. Additionally, said fine fuel flow adjuster 18 can move toward and away from said porous adjusting wad 14 in threaded engagement with said coarse fuel flow adjuster 15 independently of the rotation of said coarse fuel flow adjuster 15 so as to carry out a fine fuel flow adjustment. Said fine fuel flow adjuster 18 is so designed and arranged in said coarse fuel flow adjuster 15 that said coarse fuel flow adjuster 15 is not moved upon rotation of said fine fuel adjuster 18. Turned in clockwise direction, said fine fuel flow adjuster 18 moves upwards in threaded engagement with said coarse fuel flow adjuster 15 toward said porous adjusting wad 14 so as to apply further pressure on said porous adjusting wad 14. This operation carries out further reduction of fuel gas flow to said fuel discharge nozzle cylinder 6. If turned in counter-clockwise direction, said fine fuel flow adjuster 18 moves backwards in threaded engagement with said coarse fuel flow adjuster 15 away from said porous adjusting wad 14 so as to further loosen the pressure on said porous adjusting wad 14. This operation carries out further increase of fuel gas flow to said fuel discharge nozzle cylinder 6. Said fine fuel flow adjuster 18 can move backwards until said relatively larger end 18*a* thereof abuts against the top end of said coarse fuel flow adjuster 15 whereby maximum fuel gas flow to said fuel discharge nozzle cylinder 6 is restricted. Fine fuel flow adjustment is carried out in such a way as mentioned above. Further, as a result of this construction, said fine fuel flow adjuster 18 is prevented from falling off out of said coarse fuel flow adjuster 15 in the course of backward movement thereof.

A sealing packing 19 is arranged between the inner wall of said lower part 2*a* of said outer cylindrical body 2 and a concave 15*b* formed on the periphery of said coarse fuel flow adjuster 15 so as to form a sealing conjunction between said outer cylindrical body 2 and said coarse fuel flow adjuster 15. A fuel passage opening 20 is formed on a side wall of said outer cylindrical body 2 to make fuel communication between said fuel tank 1 and the axially-hollow interior of said outer cylindrical body 2. A sealing ring 21 disposed between said coarse fuel flow adjuster 15 and said fine fuel flow adjuster 18 serves to seal a gap therebetween.

In operation, upon lifting said fuel discharge nozzle cylinder 6 against the action of said spring 7 by means of a well-known nozzle actuation member (not shown), the fuel gas stored in said fuel tank 1 is emitted from said axial bore 9 through said porous adjusting wad 14 upon release of engagement between said resilient member 11 and said bore 13. Upon depressing said fuel discharge nozzle cylinder 6 under the influence of said spring 7, said resilient member 11 closes said bore 13 and then the fuel gas flow is stopped.

When an adjustment of fuel gas flow is desired, said coarse fuel flow adjuster 15 is rotated up and down in threaded engagement with said outer cylindrical body 2 and this rotation of said coarse fuel flow adjuster 15 causes the rotatable movement of said fine fuel flow adjuster 18 toward and away from said porous adjusting wad 14, thereby effecting a pressure change on said porous adjusting wad 14. The subsequent and simlutaneous change of fuel gas flow is then effected by such a pressure alteration. Turned in clockwise direction, said coarse fuel flow adjuster 15 together with said fine fuel flow adjuster 18 moves upwards toward said porous adjusting wad 14 so that said relatively larger end 18*a* of said fine fuel flow adjuster 18 compresses said porous adjusting wad 14 whereby fuel gas flow to said fuel discharge nozzle cylinder 6 is reduced. Turned in counter-clockwise direction, said coarse fuel flow adjuster 15 together with said fine fuel flow adjuster 18 moves downwards so that said relatively larger end 18*a* of said fine fuel flow adjuster 18 loosenes the pressure application on said porous adjusting wad 14 whereby fuel gas flow to said fuel discharge nozzle cylinder 6 is increased to a predetermined level. Said coarse fuel flow adjuster 15 together with said fine fuel flow adjuster 18 can move until said flange 16 of said coarse fuel flow adjuster 15 abuts against said pawl 17 of said outer cylindrical body 2. As a result, said coarse fuel flow adjuster 15 is prevented from falling off out of said outer cylindrical body 2 in the course of fuel flow adjustment.

If further adjustemnt of fuel gas flow is desired, for example due to the change of temperature in the air, said fine fuel flow adjuster 18 is directly rotated by a tool toward and away from said porous adjusting wad 14 in threaded engagement with said coarse fuel flow adjuster 15 thereby effecting a fine pressure change on said porous adjusting wad 14. The consequent and simultaneous change of fuel gas flow is then further effected by such a fine pressure alteration on said porous adjusting wad 14. However, downward rotation of said fine fuel flow adjuster 18 is restricted through the abutment between said relatively larger end 18*a* thereof and the top end of said coarse fuel flow adjuster 15.

Figure 2:
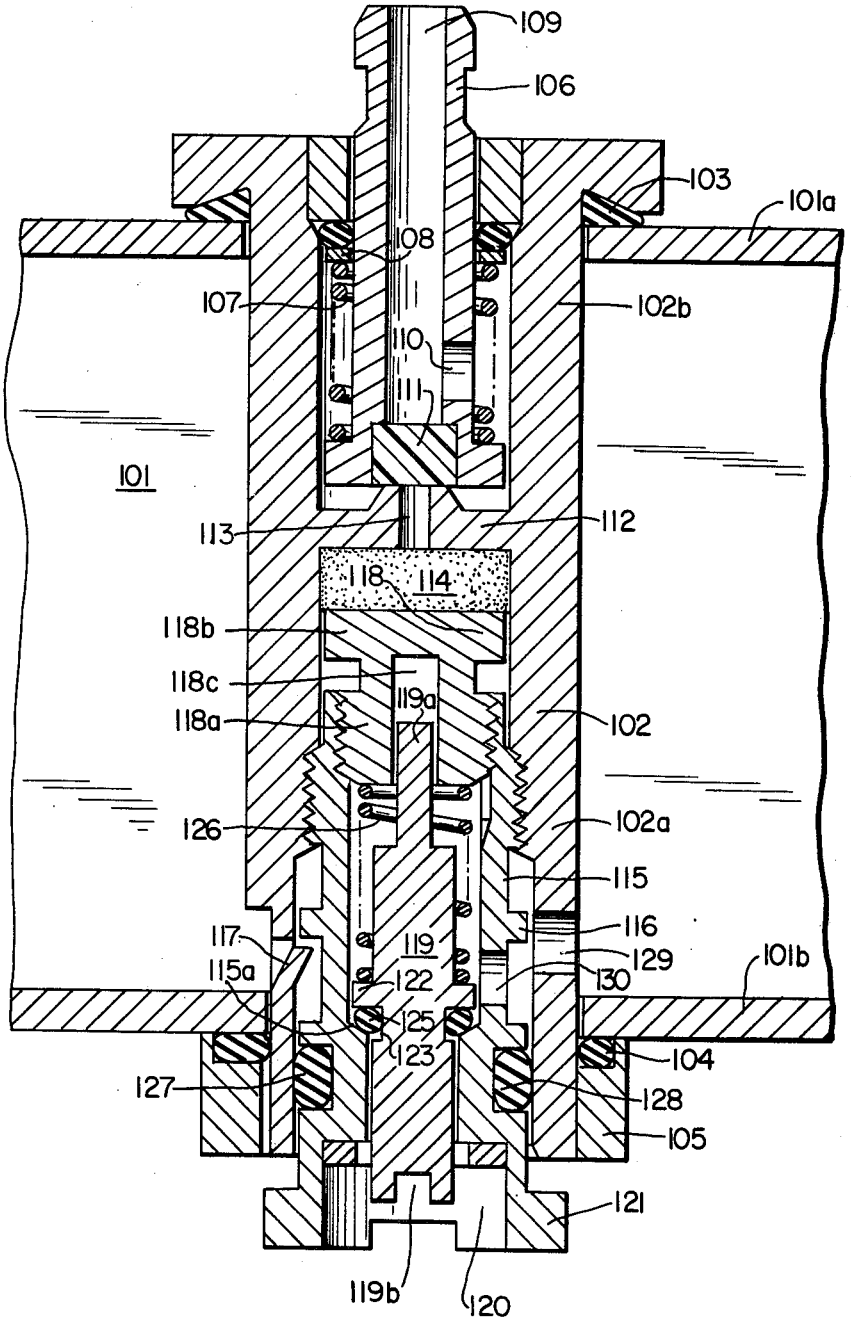
FIG. 2 is a longitudinal sectional view showing another embodiment according to the present invention.

FIG. 2 shows an another embodiment of the present invention. Referring to FIG. 2, an outer cylindrical body 102 is fixedly secured to an upper and lower walls 101*a*, 101*b* of a fuel tank 101. An upper portion 102*b* of said outer cylindrical body 102 is secured through a packing 103 on said upper wall 101*a* of said fuel tank 101 and a lower portion 102*a* of said outer cylindrical body 102 is secued through a gasket 104 to said bottom wall 101*b* of said fuel tank 101 by threaded engagement with a sleeve 105.

Located in the upper portion 102*b* of said outer cylindrical body 102 is a discharge nozzle cylinder 106 which is always biased in the downward direction by a spring 107. Said spring 107 is arranged between the bottom portion of said discharge nozzle cylinder 106 and a boss 108 formed on said discharge nozzle cylinder 106. Said discharge nozzle cylinder 106 has a longitudinal axial bore 109 crossing at a right angle a side opening 110 provided on said discharge nozzle cylinder 106 and extends to the downward end which is bordered by a resilient member 111. Said resilient member 111 contacts a top plate 112 arranged on said outer cylindrical body 102 to shut off a through-bore 113 which is formed in said top plate 112 and which communicates the interior of said fuel tank 101 with said discharge nozzle cylinder 106. Arranged under said top plate 112 is an adjusting wad of resilient porous material 114. Said porous adjusting wad 114 is adapted to alter the supply of fuel gas flow of said discharge nozzle cylinder 106.

A coarse fuel flow adjuster 115 is arranged in the lower portion 102*a* of said outer cylindrical body 102 in rotatably threaded engagement with said outer cylindrical body 102. Said coarse fuel flow adjuster 115 is integrally formed with a flange 116 on the outer periphery thereof. A pawl 117 is formed on said outer cylindrical body 102 which is integrally bent inwardly from the side wall of said outer cylindrical body 102. Said pawl 117 plays a roll as a stopper and is adapted to engage said flange 116 of said coarse fuel flow adjuster 115 at a predetermined rotation of said coarse fuel flow adjuster 115 in a counter-clockwise direction. Namely, the turn of said coarse fuel flow adjuster 115 in the counter-clockwise direction is restricted by the engagement between said flange 116 of said coarse fuel flow adjuster 115 and said pawl 117 of said outer cylindrical body 102. Thus, said flange 116 and said pawl 117 constitute a controlling means in order to restrict the downward movement of said coarse fuel flow adjuster 115. As a result of this construction, said coarse fuel flow adjuster 115 is prevented from falling off out of said outer cylindrical body 102 during loosening the pressure on said porous adjusting wad 114.

In the upper portion of said coarse fuel flow adjuster 115 is disposed a pressure head 118. The lower part 118*a* of said pressure head 118 is formed with a thread on the periphery thereof which is in rotatably threaded engagement with an upper part of said coarse fuel flow adjuster 115. Said pressure head 118 extends upwardly beyond the top end of said coarse fuel flow adjuster 115 and terminates in a relatively larger end 118*b*. Said relatively larger end 118*b* of said pressure head 118 abuts against the lower side of said porous adjusting wad 114. A groove 118*c* is arranged across the center of said lower part 118*a* of said pressure head 118.

Reference numeral 119 designates a central axis. Said central axis 119 is disposed within said coarse fuel flow adjuster 115 at the lower side of said pressure head 118 and carries out a function of a filling valve in co-operative engagement with said coarse fuel flow adjuster 115. Said filling valve 119 has a flat part 119*a* at its top end which is in engagement relation with said groove 118*c* of said pressure head 118 and has a cut part 119*b* at the bottom thereof. Said cut part 119*b* of said filling valve 119 extends outwardly in an opening 120 defined by a socket 121 which is formed on the bottom of said coarse fuel flow adjuster 115. Said filling valve 119 is further formed with a rim 122 and a concave 123 on the periphery thereof. A sealing ring 125 is arranged within said concave 123 between said filling valve 119 and said coarse fuel flow adjuster 115 so as to seal the communication therebetween. A compression spring 126 is arranged within said coarse fuel flow adjuster 115, the upper end of which contacts the bottom of said pressure head 118 and the lower end of which contacts said rim 122 of said filling valve 119. Said compression spring 126 is adapted to downwardly urge said filling valve 119 with said sealing ring 125 being contact with a shoulder 115*a* of said coarse fuel flow adjuster 115. A sealing packing 127 is arranged between the inner wall of said lower part 102*a* of said outer cylindrical body 102 and a concave 128 formed on the periphery of said coarse fuel flow adjuster 115 in order to form a sealing conjunction between said outer cylindrical body 102 and said coarse fuel flow adjuster 115.

Fuel passage openings 129, 130 are formed respectively on said outer cylindrical body 102 and on said coarse fuel flow adjuster 115. Said filling valve 119 and said pressure head 118 serve in combination as a fine fuel flow adjuster.

The operation is as follows. Upon application of a connecting tube of a conventional fuel charging container (not shown) into said opening 120, said filling valve 119 is forced inwardly to a predetermined extent against the action of said compression spring 126 and said sealing ring 125 is released from closing engagement with said shoulder 115*a* of said coarse fuel flow adjuster 115 to induce open communication between said fuel tank 101 and said fuel charging container. Simultaneously, the fuel gas in said fuel charging container is introduced into said fuel tank 101 through said fuel passage openings 129, 130.

If a change in the fuel gas flow is desired, said coarse fuel flow adjuster 115 is rotated up and down in threaded engagement with said outer cylindrical body 102 and this rotation of said coarse fuel flow adjuster 115 causes the rotatable movement of said pressure head 118 toward and away from said porous adjusting wad 114, thereby effecting a pressure change on said porous adjusting wad 114. The subsequent and simultaneous change of fuel gas flow is then correspondingly effected by such a pressure alteration on said porous adjusting wad 114. Turned in clockwise direction, said coarse fuel flow adjuster 115 together with said pressure head 118 moves upwards in threaded engagement with said outer cylindrical body 102 toward said porous adjusting wad 114 so that said relatively larger end 118*b* of said pressure head 118 compresses said porous adjusting wad 114 whereby fuel gas flow to said discharge nozzle cylinder 106 is reduced. Turned in counter-clockwise direction, said coarse fuel flow adjuster 115 together with said pressure head 118 moves downwards in threaded engagement with said outer cylindrical body 102 so that said relatively larger end 118*b* of said pressure head 118 loosens the pressure application on said porous adjusting wad 114 whereby fuel gas flow to said fuel discharge nozzle cylinder 106 is increased to a predetermined level. Said coarse fuel flow adjuster 115 together with said pressure head 118 can move until said flange 116 of said coarse fuel flow adjuster 115 abuts against said pawl 117 of said outer cylindrical body 102. As a result, said coarse fuel flow adjuster 115 is prevented from falling off out of said outer cylindlical body 102 in the course of fuel flow adjustment. If further adjustment of fuel gas flow is desired, for example due to the change of temperature in the air, said filling valve 119 is directly rotated by using a tool. Said rotation of said filling valve 119 causes the rotation of said pressure head 118 in threaded engagement with said coarse fuel flow adjuster 115 whereby the pressure on said porous adjusting wad 114 is modified and then the fuel gas flow to said discharge nozzle cylinder 106 is finely changed. However, the downward rotation of said pressure head 118 caused by the rotation of said filling valve 119 is restricted by the abutment between said relatively larger end 118*b* of said pressure head 118 and the top end of said coarse fuel flow adjuster 115.

Figure 3:
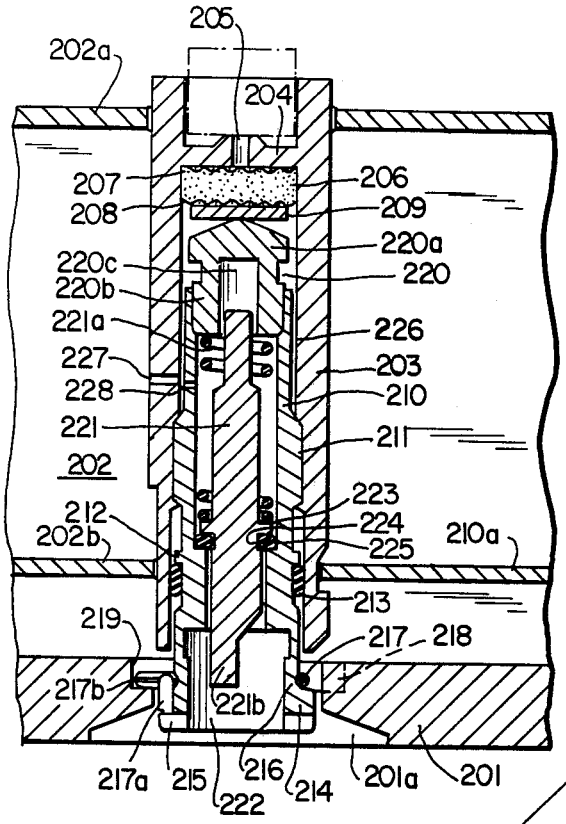
FIG. 3 is a modified embodiment of FIG. 2.
Figure 4:
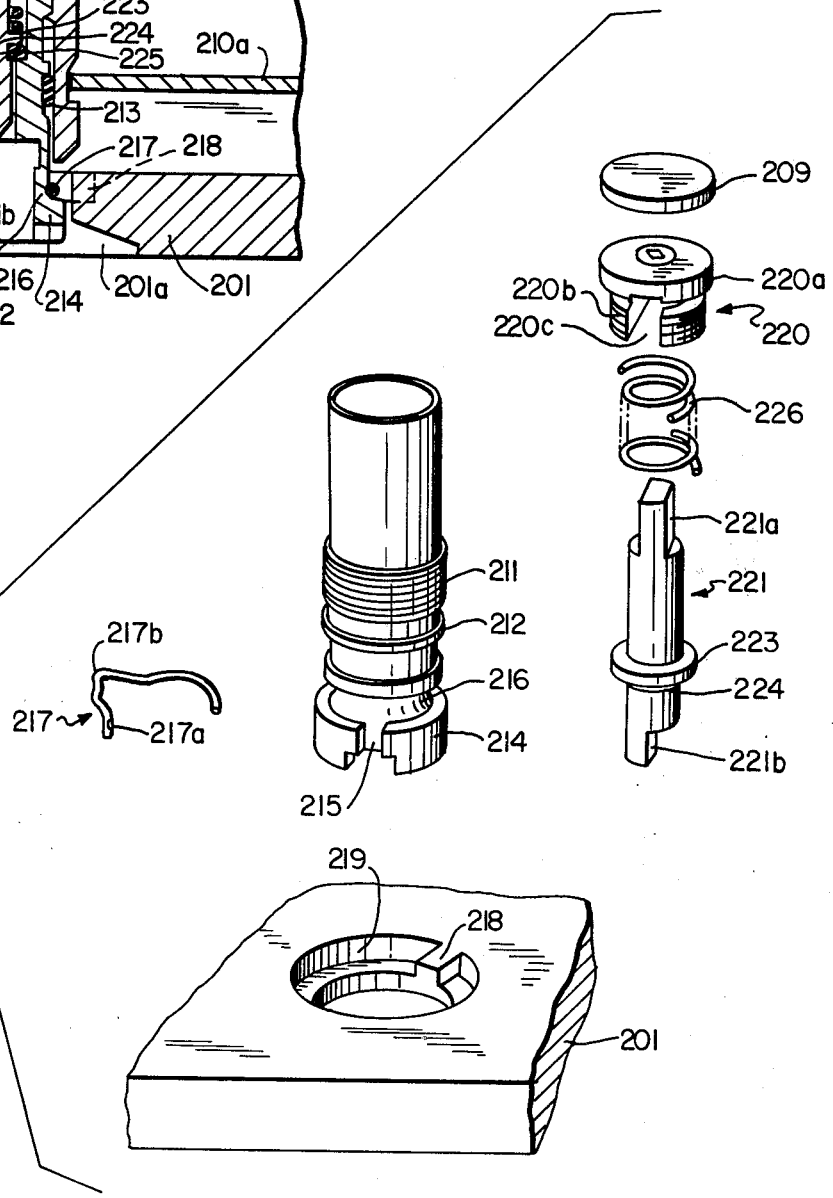
FIG. 4 is an exploded perspective view showing an essential part of FIG. 3.
Figure 5:
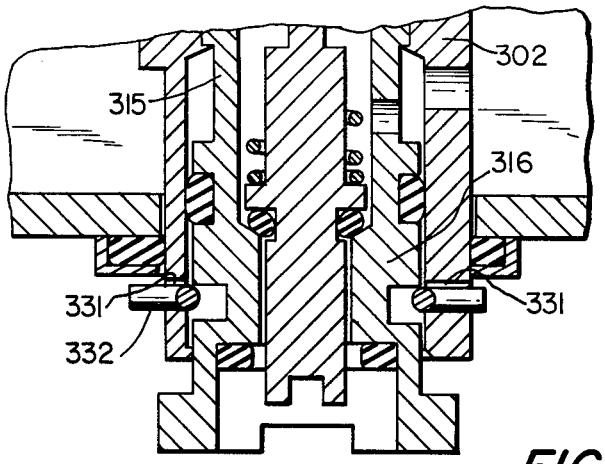
FIG. 5 is a longitudinal sectional view showing a partially modified embodiment of FIG. 2.

FIG. 3 shows a modified embodiment of FIG. 2. Referring to FIGS. 3 to 5, reference numeral 201 denotes a bottom portion of a lighter casing having an opening 201*a*. Reference numerals 202*a*, 202*b* designate an upper and lower walls of a fuel tank 202 both defining said fuel tank 202. An outer cylindrical body 203 having an axially-hollow interior extends through said fuel tank 202 and is fixedly secured to said upper and lower walls 202*a*, 202*b* of said fuel tank 202. Located in the upper section of said outer cylindrical body 203 is a valve element with a fuel discharge nozzle which is similar to said fuel discharge nozzle cylinder 106 in FIG. 2. Said valve element contacts a top plate 204 prepared on said outer cylindrical body 203 to close a bore 205 formed on said top plate 204 and communicating the interior of said fuel tank 202 with the atomosphere. Mounted in abutment on the inner side of said top plate 204 is an adjusting wad 206 of resilient porous material. Said porous adjusting wad 206 is provided on both upper and lower surfaces thereof with mesh screens 207, 208, one of which is in contact with an inner side of said top plate 204 and the other with a circular plate 209. Said circular plate 209 is slightly smaller than said adjusting wad 206 in diameter. Said porous adjusting wad 206 is adapted to change the supply of fuel gas flow to said valve element.

Installed in the lower section of said outer cylindrical body 203 is a coarse fuel flow adjuster 210. Said coarse fuel flow adjuster 210 of cylindrical shape has a threaded portion 211 on the outer periphery thereof which is in rotatably threaded engagement with said outer cylindrical body 203. A step 212 is formed on the outer periphery of said coarse fuel flow adjuster 210 under said threaded portion 211 so as to keep a gasket 213 in position between said coarse fuel flow adjuster 210 and said outer cylindrical body 203. A flange 214 is formed on the bottom of said coarse fuel flow adjuster 210 and a longitudinal slot 215 is arranged on one portion of said flange 214. A groove 216 is formed on the outer periphery of said coarse fuel flow adjuster 210 between said step 212 and said flange 214. A resilient ring 217 surrounds said groove 216 and one end 217*a* thereof extending downwards is fixedly secured to said longitudinal slot 215 so as to prevent the detachment of said resilient ring 217 from said coarse fuel flow adjuster 210. Said resilient ring 217 further has a protruding portion 217*b* which is adapted to abut against a stopper comprising a projection 218 integrally formed on the inner wall 219 of said bottom portion of said lighter casing 201 at a predetermined rotation of said coarse fuel flow adjuster 210 in both clockwise and counterclockwise direction. Therefore, the turn of said coarse fuel flow adjuster 210 in threaded engagement with said outer cylindrical body 203 is restricted by the engagement between said protruding portion 217*b* of said resilient ring 217 fixed on said coarse fuel flow adjuster 210 and said projection 218 of the bottom portion of said lighter casing 201. Thus said pretruding portion 217*b* of said resilient ring 217 and said projection 218 of said bottom portion of said lighter casing 201 constitute a controlling means to limit the downward movement of said coarse fuel flow adjuster 210. Said projection 218 may be formed on the inner wall of said outer cylindrical body 203 at the lower portion thereof.

In the upper portion of said coarse fuel flow adjuster 210 is disposed a pressure head 220 whose upper part 220*a* is of a frustconical shape. Said frustconical-shaped upper part 220*a* of said pressure head 220 abuts against said circular plate 209 around the center thereof. The lower part 220*b* of said pressure head 220 is formed with a thread on the periphery thereof. A groove 220*c* is arranged across the center of said lower part 220*b*.

Reference numeral 221 shows a central axis. This central axis 221 is arranged within said coarse fuel flow adjuster 210 at the lower side of said pressure head 220 and performs a function of a filling valve in co-operative engagement with said coarse fuel flow adjuster 210. Said filling valve 221 has a flat part 221*a* at its top end which is in engagement relation with said groove 220*c* of said pressure head 220 and has a cut part 221*b* at the bottom end thereof. Said cut part 221*b* of said filling valve 221 extends outwardly in an opening 222 defined by said flange 214 of said coarse fuel flow adjuster 210. Said filling valve 221 further has a rim 223 and a concave 224 on the outer periphery thereof. A sealing ring 225 is provided within said concave 224 between said filling valve 221 and said coarse fuel flow adjuster 210 so as to form a sealing conjunction therebetween. A compression spring 226 is arranged within said coarse fuel flow adjuster 210, the upper end of which abuts against the bottom of said pressure head 220 and the lower end of which abuts against said rim 223 of said filling valve 221. Said compression spring 226 serves to downwardly urge said filling valve 221 with said sealing ring 225 being in contact with a shoulder 210*a* of said coarse fuel flow adjuster 210. Fuel passage openings 227, 228 are formed respectively on said outer cylindrical body 203 and said coarse fuel flow adjuster 210. Said filling valve 221 and said pressure head 220 serve in combination as a fine fuel flow adjuster.

The operation is as follows. Upon application of a connecting tube of a conventional fuel charging container (not shown) into said opening 222, said filling valve 221 is forced inwardly to a predetermined extent against the action of said compression spring 226, and said sealing ring 225 is released from closing engagement with said shoulder 210*a* of said coarse fuel flow adjuster 210 to induce open communication between said fuel tank 202 and said fuel charging container. Simultaneously, the fuel gas in said fuel charging container is introduced into said fuel tank 202 through said fuel passage openings 227, 228.

If change in the fuel gas flow is desired, said coarse fuel flow adjuster 210 is rotated up and down in threaded engagement with said outer cylindrical body 203 and this rotation of said coarse fuel flow adjuster 210 causes the rotatable movement of said pressure head 220 toward and away from said porous adjusting wad 206, thereby effecting a pressure change on said porous adjusting wad 206 through said circular plate 209. The subsequent and simultaneous change of fuel gas flow is then correspondingly effected by such a pressure alteration on said porous adjusting wad 206. Turned in clockwise direction, said coarse fuel flow adjuster 210 together with said pressure head 220 moves upwards in threaded engagement with said outer cylindrical body 203 so that said pressure head 220 compresses said porous adjusting wad 206 through said circular plate 209 whereby fuel gas flow to said fuel discharge nozzle (not shown) is reduced. In this fuel flow adjustment, said coarse fuel flow adjuster 210 together with said pressure head 220 moves upwards until said protruding portion 217*b* of said resilient ring 217 fixed on said coarse fuel flow adjuster 210 abuts against said projection 218 of the bottom portion of said lighter casing 201. Accordingly, fuel gas flow is reduced within a predetermined range. Turned in counter-clockwise direction, said coarse fuel flow adjuster 210 together with said pressure head 220 moves downwards in threaded engagement with said outer cylindrical body 203 so that said pressure head 220 loosens the pressure on said porous adjusting wad 206, whereby fuel gas flow to said fuel discharge nozzle is increased. In this fuel flow adjustment, said coarse fuel flow adjuster 210 together with said pressure head 220 moves downwards until said protruding portion 217*b* of said resilient ring 217 fixed on said coarse fuel flow adjuster 210 abuts against said projection 218 of the bottom portion of said lighter casing 201. Accordingly, fuel gas flow is increased within a predetermined range. Additionally, said coarse fuel adjuster 210 is prevented from falling off out of said outer cylindrical body 203. Coarse fuel flow adjustment is carried out in such a way as mentioned above. If further fine fuel flow adjustment is desired, for example due to the change of temperature in the air, said filling valve 221 is directly rotated by a tool. Said rotation of said filling valve 221 causes the rotation of said pressure head 220 in threaded engagement with said coarse fuel flow adjuster 210 whereby the pressure on said porous adjusting wad 206 is modified and then the fuel gas flow is finely changed.

Figure 6:
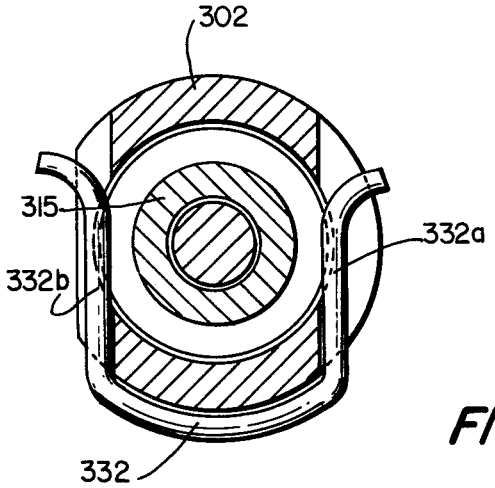
FIG. 6 is a transverse sectional view of FIG. 5.
Figure 7:
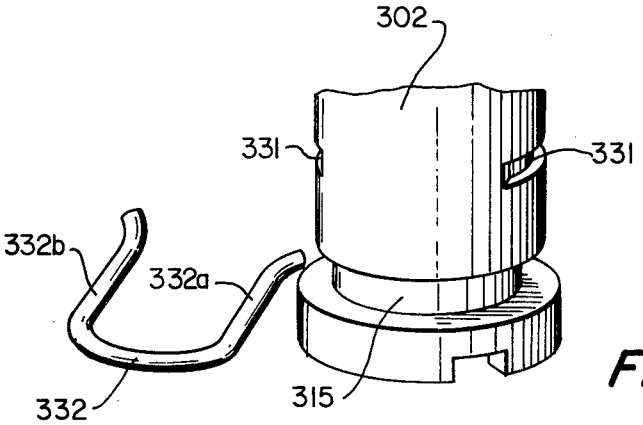
FIG. 7 is a perspective view of FIG. 5.

FIGS. 5, 6 and 7 show a partially modified embodiment of FIG. 2. Referring to FIGS. 5, 6 and 7, reference numeral 302 designates an outer cylindrical body. A coarse fuel flow adjuster 315 is arranged within said outer cylindrical body 302 in rotatably threaded engagement with said outer cylindrical body 302. Said coarse fuel flow adjuster 315 is intergrally formed with a flange 316 on the outer periphery thereof. A pair of opposed grooves 331 are formed on said outer cylindrical body 302 on the lower portion thereof. Each of the grooves 331 includes a portion penetrated into the interior of the outer cylindrical body 302. A U-shaped spring 332 is detachably disposed on said outer cylindrical body 302 whose leg portions 332*a*, 332*b* are rested in said grooves 331 of said outer cylindrical body 302. The leg portions 332*a*, 332*b* of the U-shaped spring 332 respectively protrudes into the interior of the outer cylindrical body 302 through the penetrated portions of the grooves 331. Said U-shaped spring 332 and said grooves 331 serve as a stopper and at least a portion of said U-shaped spring 332 is adpted to engage said flange 316 at a predetermined rotation of said coarse fuel flow adjuster 315. Namely, the downward movement of said coarse fuel flow adjuster 315 is restricted by the engagement between said flange 316 and said portion of said U-shaped spring 332. Thus, said flange 316, said grooves 331 and said U-shaped spring 332 constitute a controlling means in order to restrict the downward rotation of said coarse fuel flow adjuster 315. As a result of this construction, said coarse fuel flow adjuster 315 is prevented from falling off out of said outer cylindrical body 302 during the downward movement thereof. Other components and function thereof are the same with the embodiment shown in FIG. 2. Operation is also the same with FIG. 2.

What we claim is:

1. A fuel flow adjusting device for use in a gas-fueled lighter comprising:

a fuel tank having upper and lower walls;

an outer cylindrical body fixedly secured to said upper and lower walls of said fuel tank and having an axially-hollow interior, said outer cylindrical body having a transverse opening adapted to make a fuel communication between said fuel tank and said axially-hollow interior of said outer cylindrical body;

a top plate, provided on said outer cylindrical body, having a bore through the center thereof;

a fuel discharge nozzle moveably mounted on the upper portion of said outer cylindrical body;

a spring for controlling the movement of said fuel discharge nozzle;

a resilient member positioned within said outer cylindrical body for covering said bore of said top plate to control the fuel communication between said fuel discharge nozzle and said fuel tank;

an adjusting wad positioned under said top plate within said axially-hollow interior of said outer cylindrical body to control the fuel supply to said fuel discharge nozzle;

a first fuel flow adjusting means for coarsely adjusting the flow of fuel through said nozzle rotatably positioned within said axially hollow interior of said outer cylindrical body in threaded engagement therewith and having a lower end extending beyond said outer cylindrical body to define an opening therein, said first fuel flow adjusting means including a shoulder formed in the lower part thereof and being provided with a passage opening adapted to introduce fuel gas into said fuel tank;

a second fuel flow adjusting means for finely adjusting the flow of fuel through said nozzle rotatably positioned within said first fuel flow adjusting means in threaded engagement therewith, said second fuel flow adjustment means including a pressure head mounted on said first fuel flow adjusting means in rotatably engagement hterewith, said pressure head being arranged to contact with said adjusting wad for applying pressure variation on the latter;

said second fuel flow adjusting means further including a central axle telescopically positioned within said first fuel flow adjusting means in rotation-transmissive engagement with said pressure head, a lower end of said central axle extending into said opening of said first fuel flow adjusting means, wherein said pressure head has a groove on the lower side thereof and wherein said central axle operatively engages said groove of said pressure head at its upper end;

a spring arranged in engagement with said pressure head and said central axle so as to apply downward pressure on said central axle;

a first sealing member interposed between said outer cylindrical body and said first fuel flow adjusting means; and a second sealing member arranged on said central axle to form a sealing contact with said shoulder under the action of said spring.

2. A fuel flow adjusting device as set forth in claim 1, wherein said upper end of said central axle has a flat part which is received in said groove of said pressure head so as to establish the telescopic and rotation-transmissive engagement of said central axle and said pressure head.

3. A fuel flow adjusting device as set forth in claim 2, wherein said central axle has a lower end positioned in said opening of said first fuel flow adjusting means, and wherein said central axle engages said pressure head such that said central axle is linearly moveable relative to said pressure head and said pressure head is rotatable together with said central axle when said central axle is rotated at the lower end thereof.

4. A fuel flow adjusting device as set forth in claim 3, wherein said lower end of said central axle has a slot therein by which said central axle is rotated.

5. A fuel flow adjusting device as set forth in claim 4, wherein said central axle has a flange at its outer periphery, and wherein said spring engages the lower end of said pressure head and said flange of said central axle.

6. A fuel flow adjusting device as set forth in claim 5, wherein said pressure head has a larger end at its top end, said top end abutting against said upper end of said first fuel flow adjusting means such that the downward rotation of said pressure head is limited during the downward rotation of said pressure head relative to said first fuel flow adjusting means by the rotation of said central axle.

7. A fuel flow adjusting device as set forth in claim 6, wherein said central axle operates as a filling valve for introducing fuel gas into said fuel tank.

8. A fuel flow adjustng device as set forth in claim 1, wherein the downward rotation of said first fuel flow adjusting means is threaded engagement with said outer cylindrical body is limited by a controlling means positioned relative to said first fuel flow adjusting means.

9. A fuel flow adjusting device as set forth in claim 8, wherein said controlling means limits the downward rotation of said first fuel flow adjusting means when said first fuel flow adjusting means rotates in threaded engagement with said outer cylindrical body.

10. A fuel flow adjusting device as set forth in claim 9, wherein said controlling means includes a flange formed on the outer periphery of said first fuel flow adjusting means and a stopper positioned in the downward portion of the path along which said first fuel flow adjusting means rotates relative to said outer cylindrical body.

11. A fuel flow adjusting means as set forth in claim 10, wherein said stopper engages said flange on said first fuel flow adjusting means to stop the downward rotation thereof during the rotation of said first fuel flow adjusting means relative to said outer cylindrical body.

12. A fuel flow adjusting device as set forth in claim 11, wherein said stopper is positioned on said outer cylindrical body and is adapted to contact the lower side of said flange.

13. A fuel flow adjusting device as set forth in claim 12, wherein said stopper comprises a projection formed on the inner periphery of said outer cylindrical body, said projection engaging said flange of said first fuel flow adjusting means.

14. A fuel flow adjusting device as set forth in claim 13, wherein said projection is an inwardly bent pawl formed by a portion of a sidewall of said outer cylindrical body.

15. A device as set forth in claim 1, wherein said pressure head of said second adjusting means contacts said adjusting wad above the upper end of said first adjusting means.

16. A device as set forth in claim 15, wherein said first adjusting means has a lower end portion which extends downward beyond said outer cylindrical body said lower end portion having an opening therein, and wherein said second adjustng means includes a central axle which extends downward into said opening.

17. A device as set forth in claim 16, wherein said second adjusting means moves toward and away from said adjusting wad in threaded engagement with said first adjusting means upon the rotation of said central axle thereof.

* * * * *